United States Patent [19]

Flessate

[11] Patent Number: 4,805,693

[45] Date of Patent: Feb. 21, 1989

[54] MULTIPLE PIECE TUBE ASSEMBLY FOR USE IN HEAT EXCHANGERS

[75] Inventor: Dennis S. Flessate, Racine, Wis.

[73] Assignee: Modine Manufacturing, Racine, Wis.

[21] Appl. No.: 932,877

[22] Filed: Nov. 20, 1986

[51] Int. Cl.[4] ..... F28D 1/02

[52] U.S. Cl. ..... 165/153; 165/179; 29/157.3 A

[58] Field of Search ..... 165/153, 179; 138/38; 29/157.3 A, 157.3 D, 455 R

[56] References Cited

U.S. PATENT DOCUMENTS

| | | | |
|---|---|---|---|
| 265,716 | 10/1882 | Taylor | 165/153 |
| 652,658 | 6/1900 | Bischoff | 29/157.3 R |
| 686,816 | 11/1901 | Macphail | 138/38 |
| 824,493 | 6/1906 | Livingston | 165/153 |
| 1,158,576 | 11/1915 | Sonneborn | 29/157.3 R |
| 1,263,328 | 4/1918 | Kritz | 165/153 |
| 1,387,199 | 8/1921 | Small | 29/157.3 R |
| 1,665,851 | 4/1928 | Harris | 29/157.3 R |
| 2,063,757 | 12/1936 | Saunders | 165/152 |
| 2,360,123 | 10/1944 | Gerstung et al. | 165/153 |
| 2,396,522 | 3/1946 | Modine | 240/157.3 R |
| 2,526,135 | 10/1950 | Holmes et al. | 165/153 X |
| 2,642,897 | 6/1953 | Bell | 138/38 |
| 2,757,628 | 8/1956 | Johnston | 29/157.3 R |
| 2,819,731 | 1/1958 | Louthan | 29/157.3 D X |
| 2,899,177 | 8/1959 | Harris et al. | 165/153 |
| 3,021,804 | 2/1962 | Simpelaar | 165/153 X |
| 3,108,838 | 10/1963 | McCleary | 301/63 |
| 3,521,757 | 7/1970 | Brown | 165/152 |
| 3,554,150 | 1/1971 | Goetschius | 113/118 |
| 4,400,860 | 8/1983 | Nonnenmann et al. | 29/157 R |
| 4,470,452 | 9/1984 | Rhodes | 165/153 |
| 4,501,321 | 2/1985 | Real et al. | 165/153 |
| 4,570,700 | 2/1986 | Ohara et al. | 165/134.1 |

*Primary Examiner*—Ira S. Lazarus
*Assistant Examiner*—Peggy Neils
*Attorney, Agent, or Firm*—Wood, Dalton, Phillips, Mason & Rowe

[57] ABSTRACT

An internally finned multiple piece tube for use in a heat exchanger including an elongated fin 28, a first, elongated, C-shaped channel 24 having a first base 34 and spaced first legs 36, and a second, elongated C-shaped channel 26 having a second base 38 and spaced second legs 40. The fin 28 and the second channel 26 are nested in the first channel 24 between the first legs 36 thereof such that the fin 28 is sandwiched between and engaged by both the first and second bases 34 and 38 with the first legs 36 extending around and behind the second legs 40 to hold the tube 20 in assembled relation.

7 Claims, 3 Drawing Sheets

MULTIPLE PIECE TUBE ASSEMBLY FOR USE IN HEAT EXCHANGERS

FIELD OF THE INVENTION

This invention relates to heat exchangers, and more particularly, to internally finned, multiple piece tubes for use in heat exchangers.

BACKGROUND OF THE INVENTION

In the last decade or so, energy concerns have resulted in a trend toward the use of smaller engines, both diesel and spark ignition in vehicles of various types. The use of such smaller engines has resulted lower fuel consumption because of the smaller size of the engine as well as an improvement in fuel economy due to the resulting lesser vehicle weight.

At the same time, there has been an existing concern to improve the power output of the smaller engines. This, in turn, has resulted in resort to various types of energy recapture devices such as turbochargers which recapture part of the energy of the exhaust stream from a typical internal combustion engine and utilize it to increase the combustion air charge to the engine by compressing the air. While turbochargers work well for their intended purpose, in the process of compressing air, they raise the temperature thereof, thereby decreasing the density of such air, and thereby decreasing the molecular volume of oxygen fed to an engine in a given volume of air over that that would be present had the air not been heated.

This phenomena has been recognized and as a consequence, there has been increasing resort to the use of so-caller intercoolers or charge air coolers. Such coolers are heat exchangers that are placed between the outlet compressed air stream of a turbocharger and the input air stream to the internal combustion engine. By cooling the air stream after turbocharging and before it is fed to the internal combustion engine, the combustion air stream is densified with the consequence that a larger number of oxygen molecules per a given volume of air to the internal combustion engine is present. This in turn allows a larger quantity of fuel to be combusted, which, in turn, means that the output power of the engine will be increased because of the greater power available from the proper stoichiometric consumption of a greater quantity of fuel. Further, in the case of diesel engines, the use of an intercooler reduces particulate emissions.

Because charge air coolers are invariably utilized in an air to air heat exchange environment, one heat exchange fluid path (that through which the combustion air flows) must be relatively large (as, for example, compared to tubing used in vehicular radiators) so as to not unduly impede the flow of combustion air to the engine. At the same time, because weight is always a concern in the design of vehicles, it is highly desirable that the charge air cooler have a minimum weight.

As a consequence, it is highly desirable that the conduits or tubes through which the charge air flows be sufficiently large as to not impede air flow while at the same time, it is desirable that such tubes have a wall thickness as thin as possible so as to minimize the weight of the charge air cooler.

This in turn has suggested that tubes formed by extrusion processes not be used since it is impossible, or at the least, undesirably expensive to form tubes sufficiently large as to be suitable in charge air cooler applications with sufficiently thin sidewalls as to minimize both weight and material expense.

As a consequence, there have been proposals of fabricated tubes for charge air coolers made of multiple pieces. One such proposal is illustrated in U.S. Pat. No. 4,501,321 issued Feb. 26, 1985 to Real et al. In this patent, tubes are formed by utilizing inner and outer channel members each having a bottom wall and two transfer side edges. A turbulator is fitted between the channels and the channels are formed such that frictional contact between the legs of opposing channels tends to hold the tube in assembly prior to a metallurgical bonding process.

Further, the Real assembly is touted as being an adjustable one whereby the cross-sectional area (in terms of the width) may be varied to receive various sizes of turbulators.

As a practical matter, the Real solution is not altogether satisfactory. Because only frictional contact between legs of the channel exist to hold the assembly together, positive contact between various parts of the turbulator and the bases of the two channels cannot be guaranteed. Thus, heat exchange to the exterior of each tube via the turbulator or internal fin cannot be guaranteed because the possibility of air gaps between the turbulator and base of the associated channel is not precluded. Thus, while Real provides an efficiently manufactured tube construction, its efficiency in a heat exchanger such as a charge air cooler is not as great as might be desired.

The present invention is directed to overcoming one or more of the above problems.

SUMMARY OF THE INVENTION

It is the principal object of the invention to provide a new and improved internally finned multiple piece tube for use in a heat exchanger. It is also a principal object of the invention to provide a new and improved method for making such a multiple piece tube for use in a heat exchanger.

According to one facet of the invention, there is provided an internally finned, multiple piece tube for use in a heat exchanger which includes an elongated fin. There is also provided a first, elongated, C-shaped channel having a first base and spaced first legs as well as a second elongated, C-shaped channel having a second base and spaced second legs. The fin and the second channel are nested in the first channel between the first legs thereof such that the fin is sandwiched between and is engaged by both the first and second bases. The first legs extend around and behind the second legs to hold the tube in assembled relation.

As a consequence of this construction, the first channel can be fitted to the second so as to assure contact between the bases of the first and second channels and the fin.

In a highly preferred embodiment, the first legs are clinched around and behind the second legs.

The invention also contemplates that the second legs be offset from the second base in the direction toward the first base a distance which is nominally equal to the thickness of the first legs so that the first legs are clinched to a position that is an approximate extension of the adjacent part of the first base.

A highly preferred embodiment contemplates that the legs be curved.

According to another fact of the invention, there is contemplated a heat exchanger that includes a plurality of tubes as identified previously which are disposed in generally parallel, side by side relation. External fins extend between adjacent ones of the tubes and a pair of spaced tanks are each in fluid communication with associated ends of the tubes.

Still another facet of the invention includes a method of making an internally finned tube for use in a heat exchanger which includes the steps of: (a) providing an elongated fin, (b) providing a first elongated, C-shaped channel having a base and spaced legs, (c) providing a second elongated, C-shaped channel having a base and spaced legs, and (d) nesting the fin and the second channel in the first channel between the legs of latter such that the fin is sandwiched between and engaged by both of the bases and with the first channel legs extending around and behind the second channel legs to hold the tube in assembled relation.

The highly preferred embodiment of the invention also contemplates that steps (b) and (c) above are performed by forming elongated strips with dies.

The invention further contemplates that step (d) includes a step (d-1) of assembling the channels and fin together followed by the step of (d-2) clinching the first channel legs around and behind the second channel legs.

The method of the invention also contemplates that step (c) includes the forming of offsets between the second channel legs and the second channel base and that step (d-2) includes the step of clinching the ends of the first channel legs into the respective ones of the offsets.

In a highly preferred embodiment, step (d-2) further includes the step of clinching the ends of the first channel legs into the respective offsets so as to be in substantially coplanar relationship with the second channel base.

Other objects and advantages will become apparent from the following specification taken in connection with the accompanying drawings.

DESCRIPTION OF THE DRAWINGS

FIG. 3 illustrates a first step in forming a first C-shaped channel used in forming the tube;

FIG. 4 illustrates a second step in forming the first channel;

FIG. 5 illustrates a first step in forming a second channel employed in the manufacturing the tube;

FIG. 6 illustrates a second step in the forming of the second channel;

FIG. 7 illustrates a basic assembly step in assembling the second channel and a fin to the first channel;

FIG. 8 illustrates a further step in the assembly of the various components together; and FIG. 9 illustrates a final step in assembling the components together to result in a tube having the configuration illustrated in FIG. 2.

DESCRIPTION OF THE PREFERRED EMBODIMENT

Figure 1:
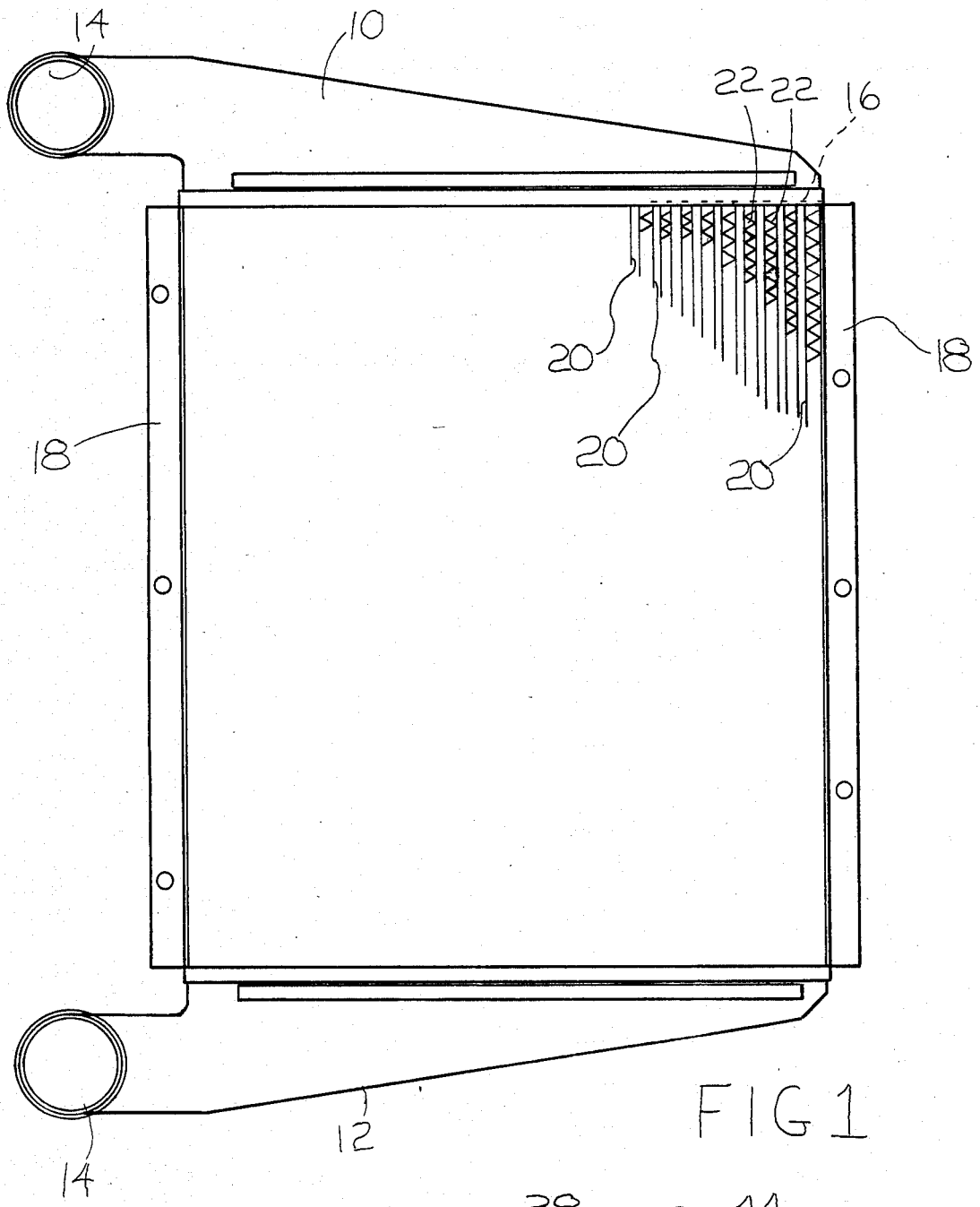
FIG. 1 is a plan view of a heat exchanger, specifically, a charge air cooler, made according to the invention.

An exemplary embodiment of a heat exchanger made according to the invention and embodying a tube made according to the invention which in turn is manufactured by a method according to the invention is illustrated in FIG. 1. The same is seen to include upper and lower manifolds or tanks 10 and 12, respectively. Each is provided with an opening 14 for ingress or egress of a heat exchange fluid. In the case of the embodiment illustrated in FIG. 1, the heat exchanger is intended for use as a charged air cooler or a so-called intercooler so that one of the openings 14 will be utilized to receive compressed air from a turbocharger while the other of the openings 14 will be utilized to direct combustion air to an internal combustion engine.

The configuration of the tanks or manifolds 10 and 12 is conventional and as will be appreciated by those skilled in the art, the same are connected to a respective header plate, one of which is shown fragmatically at 16.

Mounting channels or side members 18 interconnect the header plates 16 and manifolds 10 and 12 at opposite sides of the same and extending between the header plates 16 are a plurality of tubes 20 made according to the invention. The tubes have respective ends in fluid communication with the interiors of associated ones of the manifolds 10 and 12 and are arranged in generally parallel relation. Serpentine fins 22 extend between adjacent ones of the tubes 20. However, those skilled in the art will recognize that the serpentine fins 22 could be replaced with so-called plate fins if desired. As is well known, the serpentine fins 22 will be metallurgically bonded to the exterior of the tubes 20, typically as by soldering or brazing or the like.

In any event, charge air from a turbocharger or the like is introduced into one of the manifolds 10 and 12 via the associated opening 14 and will then flow via the interiors of the tubes 20 to the other of the manifolds 10 or 12 and exit the opening 14 associated therewith to be directed to the intake of the internal combustion engine with which the heat exchanger is to be utilized. Such charged air, being heated by compression as the result of passing through the compressor section of the turbocharger (not shown), will be cooled within the heat exchanger by air passing between the tubes 20 and in heat exchange contact not only with the sides of the tubes 20, but with the serpentine fins 22 as well.

Figure 2:
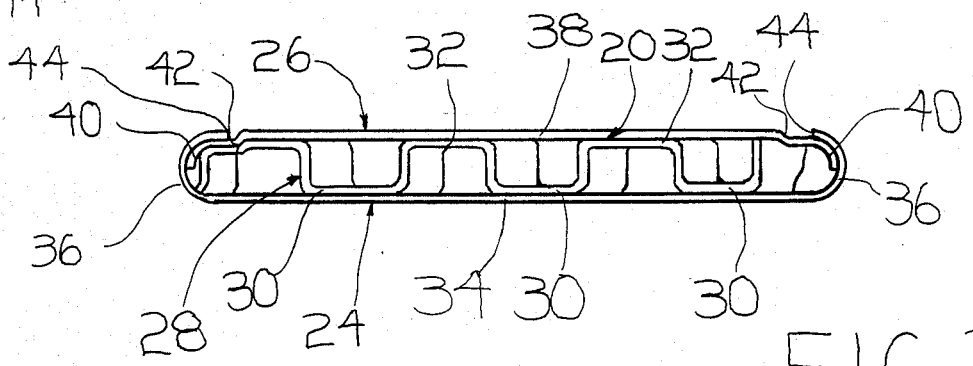
FIG. 2 is an end view of a tube employed in the heat exchanger.
Figure 3:
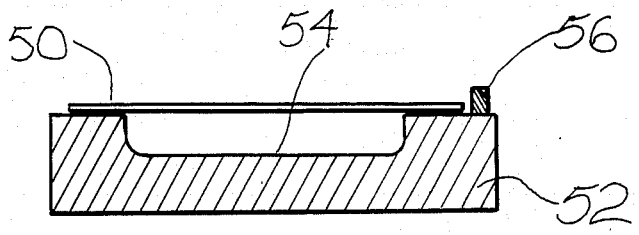
FIGS. 3–9 illustrate various steps in a preferred method of forming the tube illustrated in FIG. 2 as follows.
Figure 4:
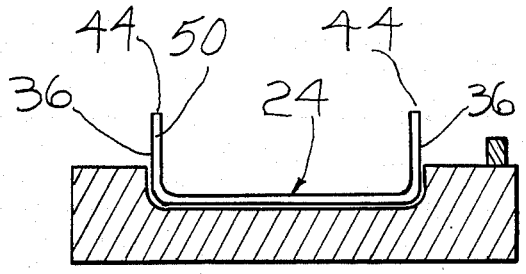

Turning now to FIG. 2, the construction of each of the tubes 20 will be described. Each is composed of three basic components. A first component is a shallow, first channel, generally designated 24, of generally C-shaped cross section. A second component is a relatively shallow, second channel of C-shaped configuration generally designated 26. The channels 24 and 26 are in nested relation with the latter being nested within the former so as to sandwich the third component of the construction which is an internal fin, or turbulator, generally designated 28. The turbulator 28 may be of any configuration known in the art and its configuration forms no part of the present invention. It is sufficient to note that usually the same will be of generally undulating form so that it will have opposed crests 30 and 32 in a generally repetitive fashion.

Generally speaking, the components will all be formed of a metal conducive to ready heat transfer such as copper, brass or aluminum. However, any material capable of suitably efficient heat transfer for the intended application of tubes may be utilized and this may include various plastics. Where metal components are utilized, they will typically be clad with braze metal, solder or the like that will ultimately bond all three tube components together.

Looking first at the first channel 24, the same includes an elongated base 34 terminating in curved legs 36 at each end thereof. The second channel 26 likewise includes a generally planar base 38 terminating in opposed legs 40 of curved configuration. The legs 40 are curved so as to generally mate with the inner surface of the curved legs 36 of first channel 24.

As can be seen from FIG. 2, at the point of intersection of the base 38 and each of the legs 40 of the second channel 26, there is a slight offset 42. The offset is in the direction of the base 34 of the first channel 24 and is approximately equal to the nominal thickness of the legs 36 of the first channel 24. The latter are clinched upon the legs 40 of the second channel 26 at the offsets 42 such that the ends 44 of the legs 36 are essentially coplanar with the base 38 of the second channel 26 and act as a continuation thereof. This configuration is desirable in that it allows the serpentine fins 22 to be placed in good heat exchange contact along the entire length of the base 38 without being partially deflected away therefrom by the legs 36.

The arrangement is further such that the first and second channels 24 and 26 sandwich the internal fin 26 and engage corresponding ones of the crests 30 and 32. For example, the crests 30 are engaged by the base 34 the first channel 24 while the crests 32 of the fin 28 are engaged by the base 38 of the second channel 26. In the usual case, some sort of bond as a metallurgical bond will also be present as will be described hereinafter.

In a typical case, the tube, when employed in a charge air cooler, will have the length of about 2⅝ inches and the width of about 5/16 inch, both being external dimensions.

FIGS. 3–9, inclusive, illustrate a preferred method of forming the tube illustrated in FIG. 2.

The channel 24 is formed by placing a strip 50 above a first die 52 having a die cavity 54. The strip 50 is abutted against a stop 56 and is elongated. Any suitable means are utilized to drive the strip 50 into the die cavity 54. As a consequence, the strip 50 assumes the configuration illustrated in FIG. 4. In this configuration, a channel ultimately to be the channel 24 is generally U-shaped in configuration and corresponding parts of the channel 24 are given like reference numerals so as to enable the steps of fabrication to be followed.

Figure 5:
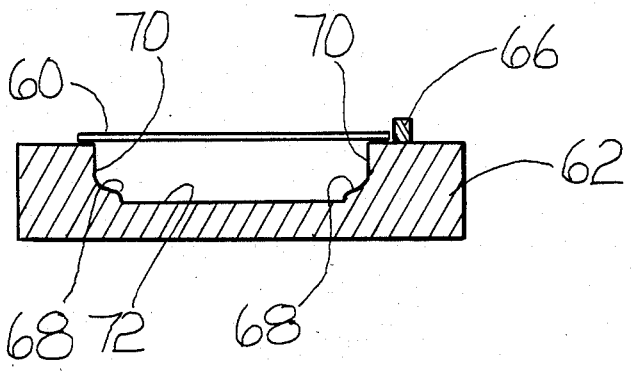

Turning now to FIG. 5, a means of fabricating the channel 26 is illustrated. In particularly, a strip 60 of somewhat lesser width, but having the same elongation as the strip 50, is located above a die 62 having a cavity 64. A stop 66 is likewise utilized to position the strip 60. It will be noted that the die cavity 64 includes what may be termed ridges 68 at the junctions between the sidewalls 70 of the die cavity 64 and the bottom 72 thereof. The ridges 68 are configured so as to provide the offsets 42 in the second channel 26.

Figure 6:
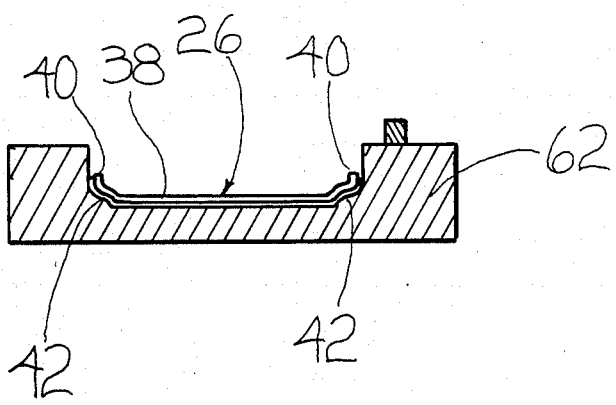

In any event, by suitable means, the strip 60 is formed into the die cavity 64 as illustrated in FIG. 6 and now has assumed the basic shape of the second channel 26.

Figure 7:
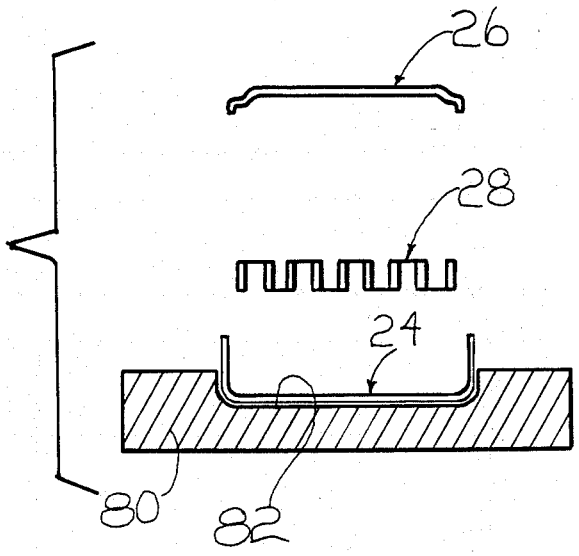

The next step in the process is to locate the partially formed channel 24 in a die 80 as illustrated in FIG. 7. The die 80 has a die cavity 82 and, may in fact, be the die 52 (FIG. 3) or a different, but otherwise identical die.

Figure 8:
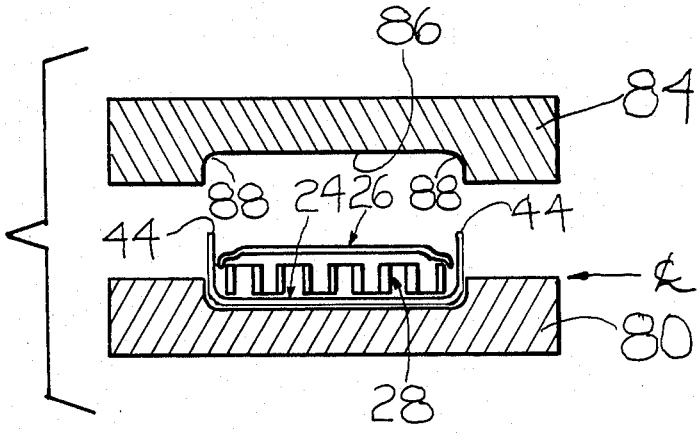

The turbulator or fin 28 if not previously placed in the channel 24 is then dropped in the upwardly facing channel 24 and the channel 26 nested in the channel 24 above the fin as illustrated in FIG. 8. At this point, a second die 84 having a downwardly opening die cavity 86 is brought into juxtaposition above the die 80. The die cavity 86 of the die 84 has curved corners 88 which engage the ends 44 of the strip forming the channel 24 that extend out of the die 80. As a consequence, the ends 44 are formed somewhat inwardly as illustrated in FIG. 9 to partially overlie and be located behind the legs 40 of the channel 26 in the area of the offsets 42.

At this stage, a clinching die 90 is brought upon the ends 44 of the legs 40. Curved corners 94 of a die recess 96 cause the ends 44 of the legs 36 to be brought into clinching relationship with the legs 40 of the second channel 26 within the offsets 42. The offsets 42 are preferably configured so as to be equal to the nominal thickness of the ends 44 of the legs 36 so that the ends 44 are essentially coplanar with the base 38 of the second channel 26 as best seen in FIG. 2.

Though the method of making the tube has been described herein as being accomplished through the use of dies, those skilled in the art will recognize that the same method can be performed in continuous form through a rolling process and that parts of the method can be formed by die forming while other parts can be formed by roll forming. The steps performed in FIGS. 4 and 6, for example, can be advantageously and easily accomplished by roll forming.

Figure 9:
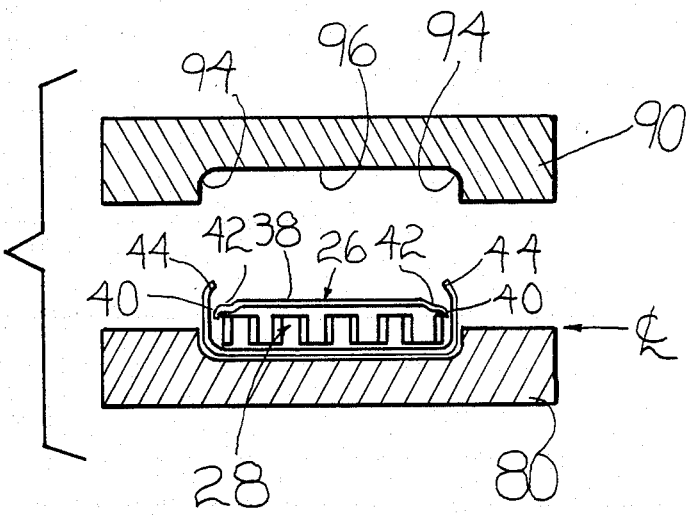

It will be appreciated that the final step illustrated in FIG. 9 brings the base 38 of the second channel 26 into engaging and sandwiching relation with the internal fin 28 and in turn drives the same against the base 30 of the first channel 24. As a consequence, good heat transfer contact is established between the crests 30 and 32 and the respective bases 34 and 38.

The arrangement is such that the clinching holds the tube in assembled relation so as to allow the same to be assembled in a suitable fixture along with header plates such as the header plate 16 (FIG. 1) and interposed serpentine fins such as those shown at 22 (FIG. 1). In a typical case, the various elements may be clad with braze metal or solder, and flux if required before forming, and after assembled to the header plates, and even to the manifolds 10 and 12, subjected to a heating operation to simultaneously obtain the desired bond not only between the fin 28 and the channels 24 and 26, but the conventional and desired bond between the serpentine fins 22 and the various tubes 20 and such other bonds as may be desirably formed by soldering or brazing, etc. in the entire unit.

From the foregoing, it will be appreciated that the invention provides a heat exchanger and a method of manufacturing the same out of multiple components which is ideally suited for the formation of tubes with internal fins for conduction of a gaseous heat exchange fluid while minimizing the wall thickness of the tubes to minimize material expense as well as weight of the ultimate heat exchanger. The method assures excellent heat exchange contact between the internal fin and the channel components forming the tube to maximize heat transfer capability.

What is claimed:

1. A method of making an internally finned tube for use in a heat exchanger comprising the steps of:

(a) providing an elongated fin;

(b) providing a first elongated, C-shaped channel having a base and spaced legs;

(c) providing a second elongated, C-shaped channel having a base and spaced legs with offsets between said legs and said base; and (d) nesting said fin and said second channel in said first channel between the legs thereof such that said fin is sandwiched between and engaged by both of said bases and with said first channel legs extending around and behind said second channel legs into respective ones of said offsets so as to be substantially coplanar with said second channel base to hold said tube in assembled relation.

2. The method of claim 1 wherein step (d) includes the step of clinching said first channel legs around and behind said second channel legs into respective ones of said offsets.

3. An internally finned multiple piece tube for use in a heat exchanger comprising:

an elongated fin;

a first, elongated, C-shaped channel having a first base and spaced first legs; and a second elongated, C-shaped channel having a second base and spaced second legs;

said fin and said second channel being nested in said first channel between said first legs thereof such that said fin is sandwiched between and engaged by both said first and second bases, said first legs extending and clinched around and behind said second legs to hold said tube in assembled relation;

said second legs being offset from said second base in the direction toward said first base a distance nominally equal to the thickness of said first legs so that said first legs are clinched to positions that are approximate extensions of said first base.

4. The tube of claim 3 wherein said legs are curved.

5. A heat exchanger comprising:

a plurality of tubes according to claim 3 in generally parallel, side-by-side relation;

external fins extending between adjacent ones of said tubes; and a pair of spaced tanks each in fluid communication with associated ends of said tubes.

6. The method of claim 1 wherein steps (b) and (c) are performed by forming elongated strips with dies.

7. The method of claim 1 wherein steps (b) and (c) are performed by forming elongated, generally planar strips.

* * * * *